US008622850B2

(12) United States Patent
Narita et al.

(10) Patent No.: US 8,622,850 B2
(45) Date of Patent: Jan. 7, 2014

(54) PUTTER HEAD

(75) Inventors: Tadahiro Narita, Chichibu (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 182 days.

(21) Appl. No.: 13/240,660

(22) Filed: Sep. 22, 2011

(65) Prior Publication Data

US 2012/0157226 A1 Jun. 21, 2012

(30) Foreign Application Priority Data

Dec. 17, 2010 (JP) ..... 2010-281803
Dec. 17, 2010 (JP) ..... 2010-281806
Dec. 24, 2010 (JP) ..... 2010-287827

(51) Int. Cl.
*A63B 53/04* (2006.01)

(52) U.S. Cl.
USPC ..... 473/329; 473/331; 473/332; 473/342; 473/349

(58) Field of Classification Search
USPC ..... 473/324–350
See application file for complete search history.

(56) References Cited

U.S. PATENT DOCUMENTS 5,358,249 A * 10/1994 Mendralla ..... 473/331
6,592,467 B1 7/2003 Gray
6,699,140 B1 3/2004 Sun
6,849,004 B2 * 2/2005 Lindsay ..... 473/330
7,278,926 B2 10/2007 Frame
7,465,240 B2 12/2008 Frame
7,500,923 B2 3/2009 Tateno
7,780,549 B2 * 8/2010 Park et al. ..... 473/331
7,862,449 B2 * 1/2011 Stites et al. ..... 473/329
7,927,230 B2 * 4/2011 Solheim ..... 473/329
8,083,611 B2 * 12/2011 Kuan et al. ..... 473/340
8,216,081 B2 * 7/2012 Snyder et al. ..... 473/251
2005/0009623 A1 * 1/2005 Dickinson ..... 473/329
2005/0209020 A1 * 9/2005 Burrows ..... 473/330
2007/0099723 A1 5/2007 Tateno
2007/0099725 A1 5/2007 Tateno
2009/0105008 A1 4/2009 Kuan et al.
2009/0286620 A1 11/2009 Franklin et al.
2009/0286621 A1 11/2009 Franklin et al.
2010/0087269 A1 4/2010 Snyder et al.
2010/0113184 A1 5/2010 Kuan et al.

FOREIGN PATENT DOCUMENTS

JP 2001-062008 A 3/2001
JP 2007-117472 A 5/2007
JP 2007-117635 A 5/2007
JP 2009-297210 A 12/2009
JP 2010-63481 A 3/2010
JP 2010-110616 A 5/2010
JP 2010-110621 A 5/2010
JP 4643417 B2 3/2011

* cited by examiner

*Primary Examiner* — Sebastiano Passaniti
(74) *Attorney, Agent, or Firm* — Sughrue Mion, PLLC

(57) ABSTRACT

This invention provides a putter head comprising a head body and a face insert mounted on a face surface of the head body. Slits are vertically aligned in multiple stages so as to extend in the face insert in a toe-to-heel direction. A depending portion is provided in the slit on a side of the face surface so as to reduce a vertical dimension of the slit. The slit is filled with a viscoelastic material.

9 Claims, 23 Drawing Sheets

PUTTER HEAD

BACKGROUND OF THE INVENTION

1. Field of the Invention

The present invention relates to the putter head of a golf putter and, more particularly, to a putter head including a face insert mounted on the face surface of the head body.

2. Description of the Related Art

A golf putter is a club that is mainly used to hit a ball on a green and roll it toward a cup. Japanese Patent Laid-Open No. 2007-117635 describes a technique for mounting a face insert on the face surface of a putter head to soften an impact feel.

Japanese Patent Laid-Open No. 2001-62008 describes a putter head in which the lower portion of the face surface is integrated with a synthetic resin foam to easily impart top spin to a ball. However, a synthetic resin foam has characteristics with a strong temperature dependence, so the effect of top spin changes considerably depending on the air temperature.

SUMMARY OF THE INVENTION

It is an object of the present invention to improve spin on a ball.

According to an aspect of the present invention, there is provided a putter head comprising a head body and a face insert mounted on a face surface of the head body, wherein slits are vertically aligned in multiple stages so as to extend in the face insert in a toe-to-heel direction, a depending portion is provided in the slit on a side of the face surface so as to reduce a vertical dimension of the slit, and the slit is filled with a viscoelastic material.

According to another aspect of the present invention, there is provided a putter head comprising a head body and a face insert mounted on a face surface of the head body, wherein slits are vertically aligned in multiple stages so as to extend in the face insert in a toe-to-heel direction, a raised portion is provided in the slit on a side of the face surface so as to reduce a vertical dimension of the slit, and the slit is filled with a viscoelastic material.

According to still another aspect of the present invention, there is provided a putter head comprising a head body and a face insert mounted on a face surface of the head body, wherein the face insert includes a plate-shaped face insert body formed from a viscoelastic body, and a plurality of blades which are vertically buried in multiple stages in at least a front surface portion of the face insert body, and the blade extends in a toe-to-heel direction, and a front end thereof is lower than a rear end thereof.

Further features of the present invention will become apparent from the following description of exemplary embodiments with reference to the attached drawings.

DESCRIPTION OF THE EMBODIMENTS

First Embodiment

Figure 1A:
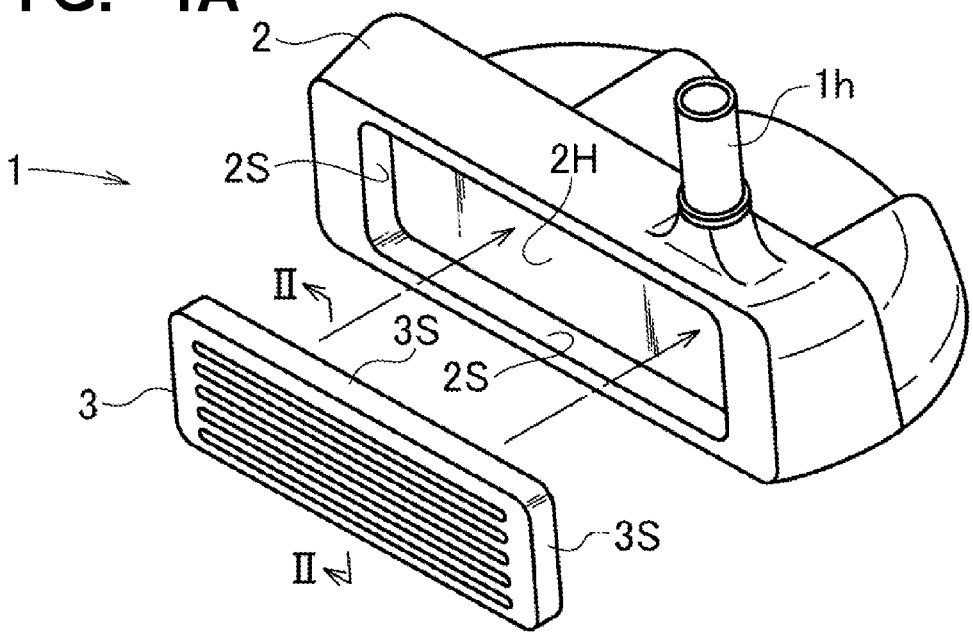
FIG. 1A is an exploded perspective view of a putter head according to an embodiment.

This embodiment provides a putter head which imparts back spin, that is smaller in amount than in a general putter, to a ball upon striking the ball, to eventually facilitate creation of top spin of the ball, and exhibits a degree of top spin, that has a small temperature dependence.

FIGS. 1A to 4 show a putter head 1 according to the first embodiment. The putter head 1 is provided with a recessed portion 2H in the front surface (face surface) of a head body 2, and a face insert 3 is disposed in the recessed portion 2H. In this embodiment, the head body 2 is made of a metal such as an aluminum alloy, a titanium alloy, a copper alloy, or stainless steel. The body portion (a portion other than viscoelastic materials 3*b*; to be described later) of the face insert 3 is made of a synthetic resin such as polyester, nylon, or urethane, or a metal such as an aluminum alloy, a copper alloy, or stainless steel. The front surface of the face insert 3 is flush with that of the head body 2 around the recessed portion 2H.

The recessed portion 2H and face insert 3 have an elongated, almost rectangular shape. The recessed portion 2H has a uniform depth as a whole, and the face insert 3 has a uniform thickness as a whole as well. However, the recessed portion 2H and face insert 3 may be partly provided with a deep portion and thick portion, respectively, or conversely, a shallow portion and thin portion, respectively.

The face insert 3 has a horizontal dimension and vertical dimension that is slightly smaller than the recessed portion 2H, so a small gap 4 is formed between upper, lower, left, and right side surfaces 3S of the face insert 3 and a peripheral surface 2S of the recessed portion 2H. The width of the gap 4 is preferably 0.3 to 1.5 mm and more preferably about 0.4 to 1.0 mm. As for the size of the face insert 3, its vertical dimension is preferably 16 to 30 mm and more preferably about 18 to 25 mm, its horizontal dimension is preferably 50 to 150 mm and more preferably about 70 to 100 mm, and its thickness is preferably 2 to 10 mm and more preferably about 3 to 8 mm. However, the size of the face insert 3 is not limited to these specific values.

Figure 2:
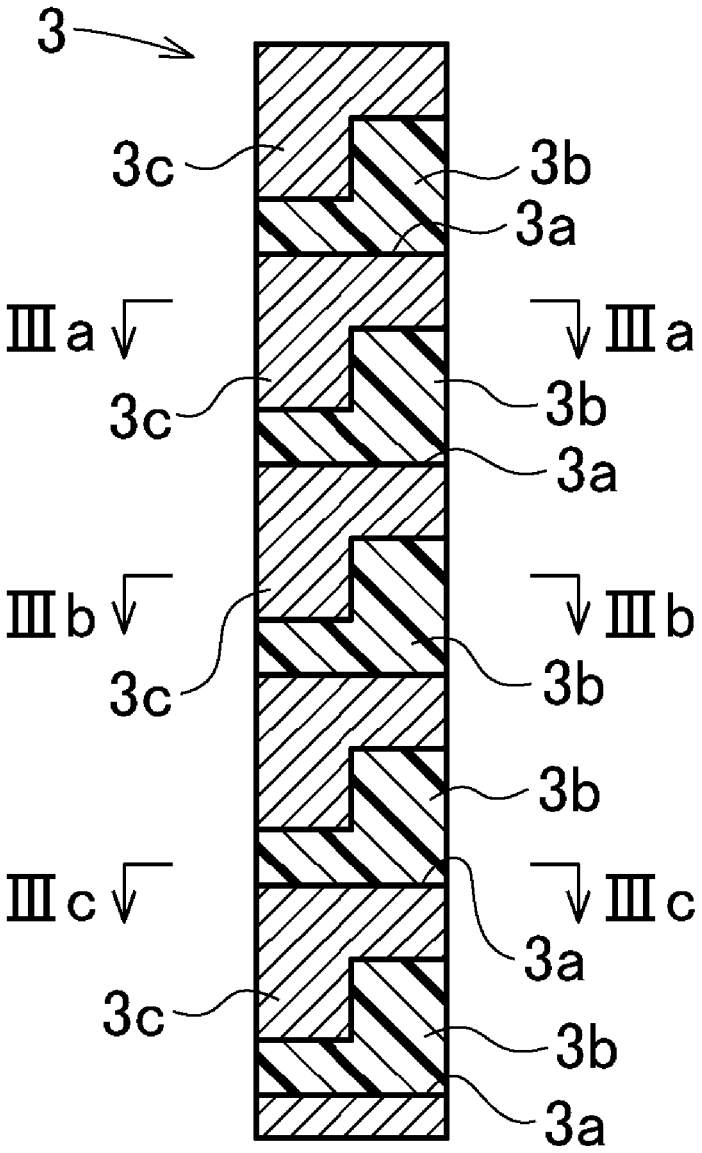
FIG. 2 is an enlarged sectional view taken along a line II-II in FIG. 1A.
Figures 3A, 3B, 3C:
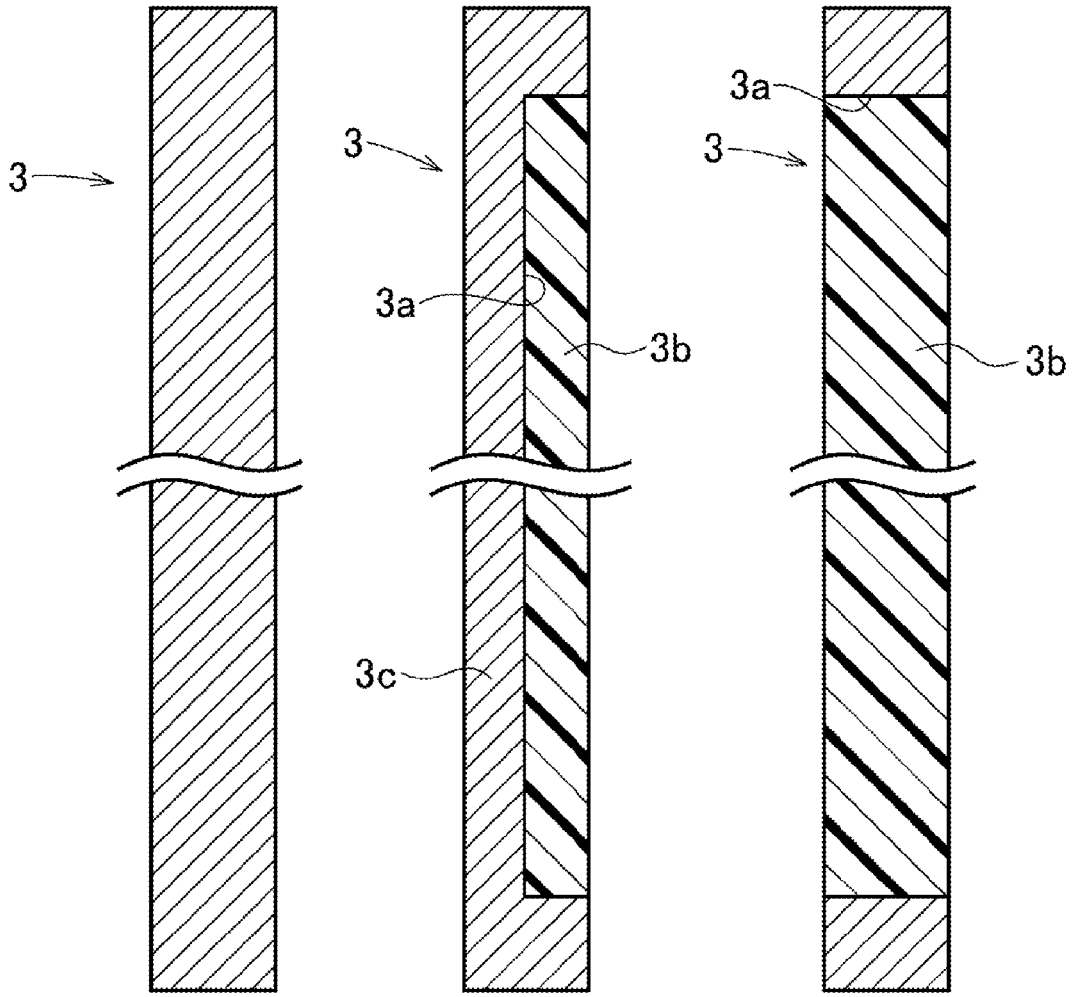
FIGS. 3A to 3C are sectional views taken along lines IIIa-IIIa, IIIb-IIIb, and IIIc-IIIc, respectively, in FIG. 2.
Figure 4:
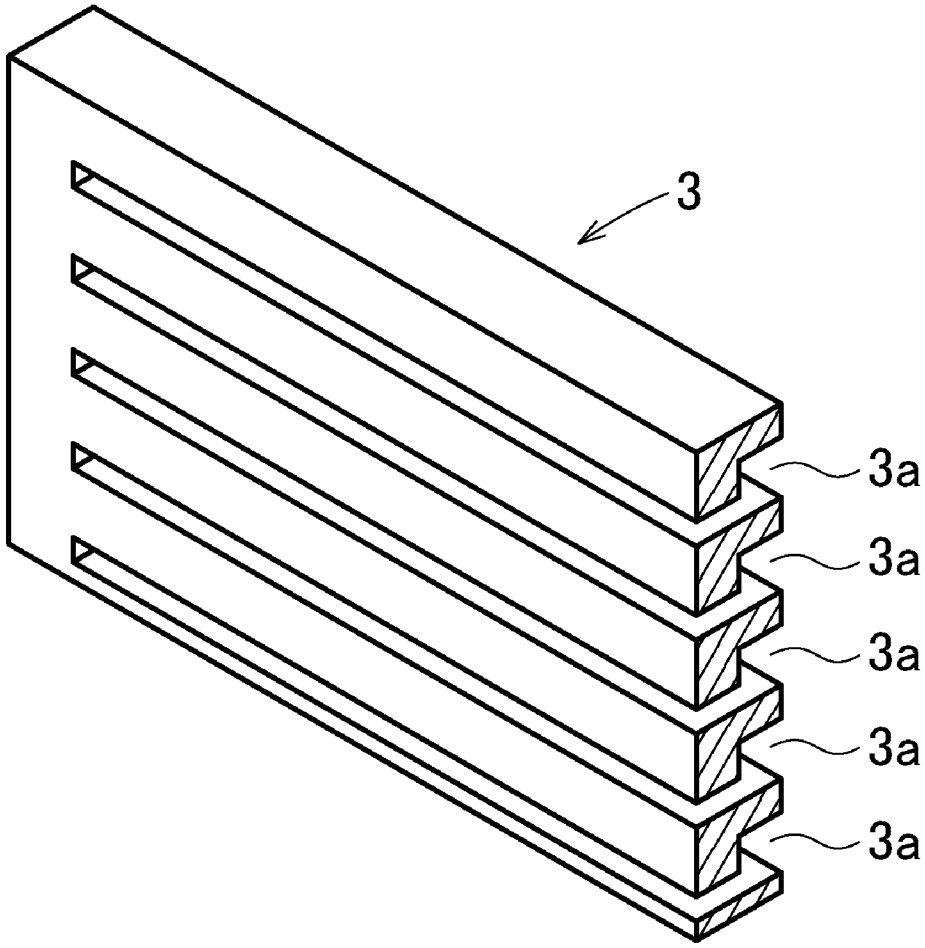
FIG. 4 is a sectional perspective view of the body portion of a face insert from which viscoelastic materials are removed.
Figure 5A:
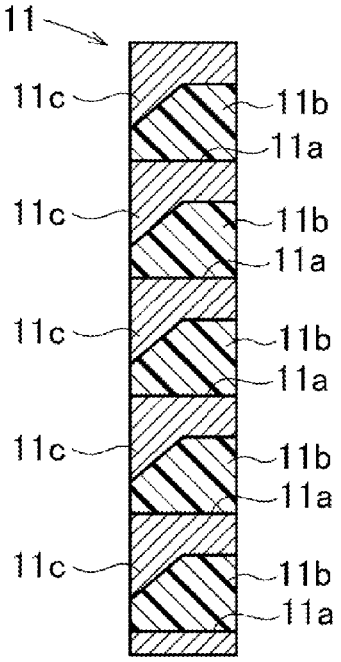
FIGS. 5A to 5D are sectional views of face inserts of putter heads each according to another embodiment.
Figure 5B:
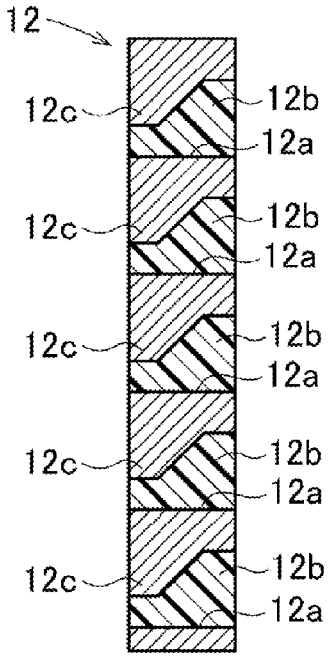
Figure 5C:
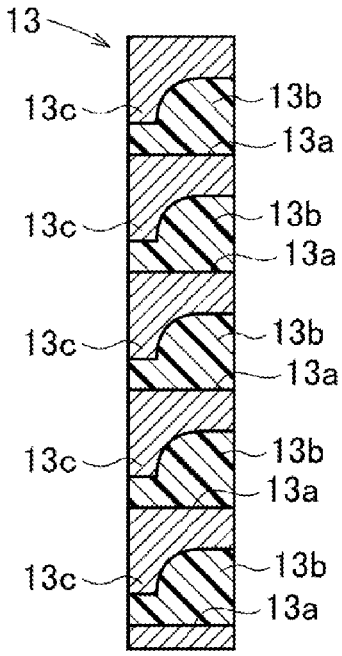
Figure 5D:
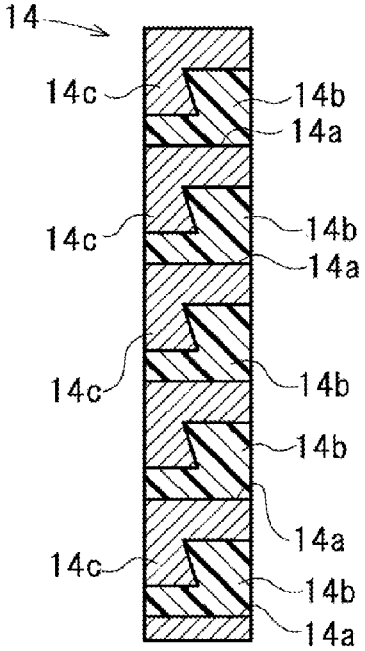

The face insert 3 is provided with slits 3*a* which are vertically aligned in multiple stages so as to extend horizontally, and each of which is filled with a viscoelastic material 3*b*, as shown in FIGS. 2 to 4. Rubber, an elastomer, or a soft synthetic resin, for example, is used as the viscoelastic material 3*b*.

The slit 3*a* extends from the vicinity of the left end of the face insert 3 to that of its right end. The slit 3*a* has a relatively small vertical dimension on the side of the face surface, and has a relatively large vertical dimension on the side of the rear surface. The vertical dimension of the slit 3*a* increases stepwise in the middle of the thickness direction of the face insert 3. The body portion of the face insert 3 immediately above each slit 3*a* has an inverted L-shaped cross-section having a depending portion 3*c* on the side of the face surface.

The vertical dimension of the slit 3*a* on the side of the face surface is preferably 0.8 to 2.0 nm and more preferably about 1.0 to 1.6 mm. The vertical dimension of the slit 3*a* on the side of the rear surface is preferably about 1.4 to 4 times that on the side of the face surface. The thickness of the depending portion 3*c* (its thickness in a direction perpendicular to the face surface) is preferably 0.5 to 2.0 mm and more preferably about 0.8 to 1.2 mm. The array pitch of the slits 3*a* in the vertical direction is preferably 2.4 to 5.8 mm and more preferably about 3.4 to 4.6 mm.

The face insert 3 is disposed in the recessed portion 2H such that its left side surface when viewed in FIG. 2 becomes the face front surface of the putter, and its opposite surface is bonded to the bottom wall surface of the recessed portion 2H using an adhesive. Although an epoxy adhesive, a rubber adhesive, or a double-faced tape, for example, is suitable as an adhesive, the present invention is not limited to these specific adhesives.

A putter is formed by connecting a shaft to a hosel portion 1*h* of the thus formed putter head 1. Upon putting with this putter (striking a ball on a green with the face surface), the depending portions 3*c* of the face insert 3 slightly recede upon hitting the ball, thereby easily imparting top spin to the ball. Thus, the hit ball exhibits good rectilinear movement characteristics. The temperature has little influence on the degree of recession of the depending portions 3*c*, so the degree of top spin has little temperature dependence.

Although the rear surface of the depending portion 3*c* is almost vertical in the above-described embodiment, the rear surfaces of depending portions 11*c* to 14*c* may have shapes different from that of the depending portion 3*c*, like face inserts 11 to 14 shown in FIGS. 5A to 5D, respectively. In an example shown in FIG. 5A, the rear surface of the depending portion 11*c* is an inclined surface which is continuous with the face surface and obliquely ascends from the contact portion with it to the rear surface of the face insert 11. In an example shown in FIG. 5B, the rear surface of the depending portion 12*c* is inclined more to the rear toward its upper portion from the middle portion of the face insert 12 in its thickness direction. In an example shown in FIG. 5C, the rear surface of the depending portion 13*c* is a concavely curved surface. In an example shown in FIG. 5D, the rear surface of the depending portion 14*c* is inclined more to the front toward its upper portion from the middle portion of the face insert 14 in its thickness direction.

In all of the examples shown in FIGS. 5A to 5D, slits 11*a* to 14*a* are filled with viscoelastic materials 11*b* to 14*b*, respectively.

Although the body portion of the face insert and the front surface of the viscoelastic material are flush with each other, and the front surface of the face insert is flat in the above-described embodiment, the viscoelastic member may recede from the body portion of the face insert by about 0.05 to 1.1 mm.

Figure 1B:
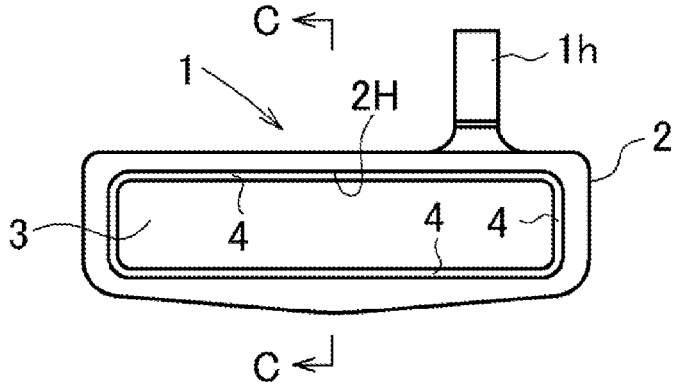
FIG. 1B is a front view of the putter head shown in FIG. 1A.
Figure 6:
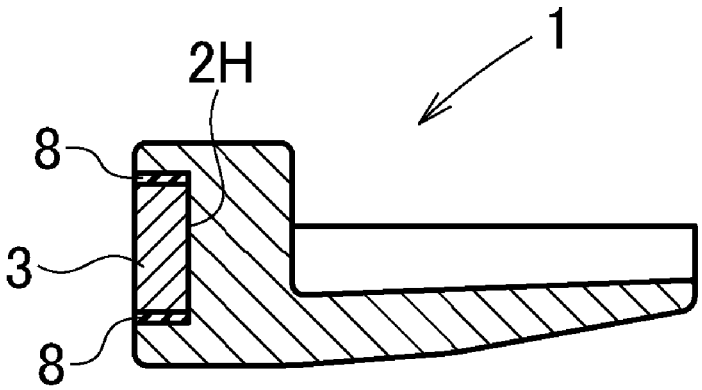
FIG. 6 is a sectional view of a putter head according to still another embodiment.
Figure 7A:
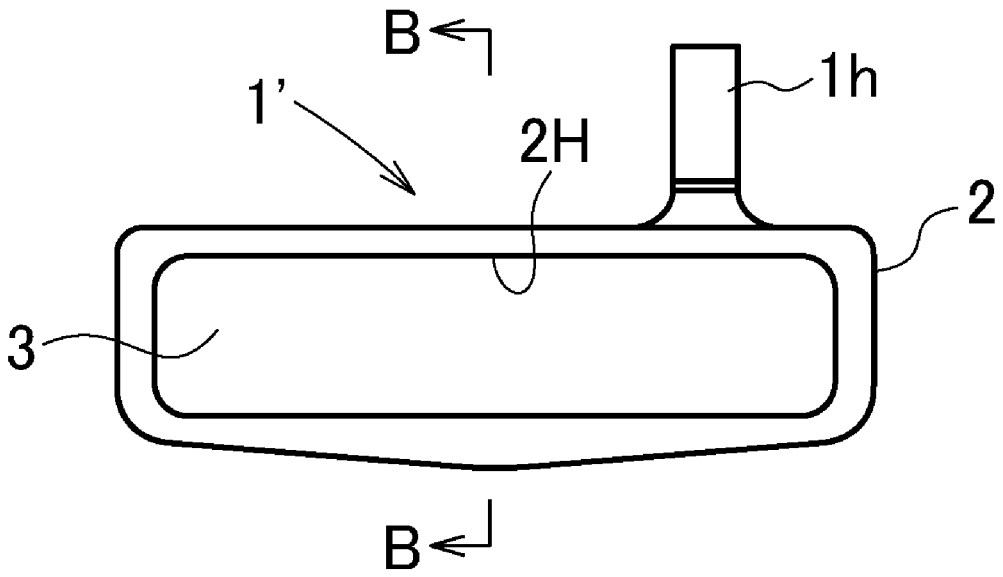
FIG. 7A is a front view of a putter head according to still another embodiment.

Although the gap 4 is formed around the face insert 3 in FIG. 1B, a viscoelastic material 8 such as rubber, an elastomer, or a synthetic resin may be disposed in the gap 4, as shown in FIG. 6. Also, like a putter head 1' shown in FIGS. 7A and 7B, the face insert 3 may be formed to tightly fit in the recessed portion 2H so as to generate no gap 4.

Figure 1C:
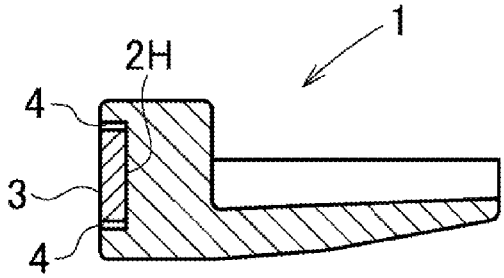
FIG. 1C is a sectional view taken along a line C-C in FIG. 1B.
Figure 7B:
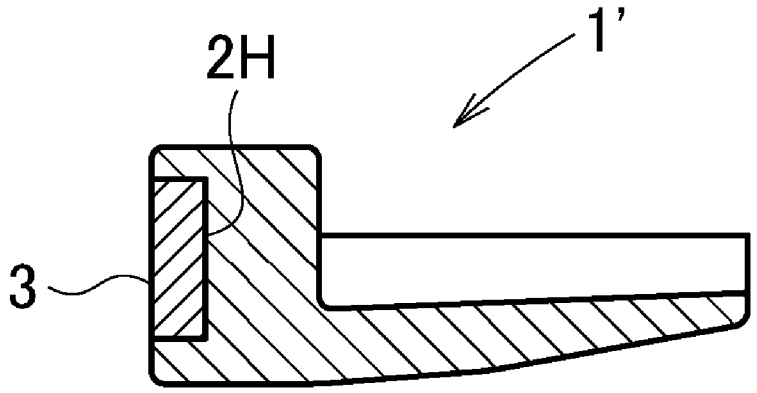
FIG. 7B is a sectional view taken along a line B-B in FIG. 7A.

Other arrangements in FIGS. 6 to 7B are the same as in FIGS. 1A to 1C, and the same reference numerals denote the same parts. When the gap 4 or the viscoelastic material 8 is provided between the side surfaces 3S of the face insert 3 and the peripheral surface 2S of the recessed portion 2H, this prevents generation of residual stress in the face insert, thus producing an effect of obtaining rebound characteristics of the face insert, which comply with the design.

Second Embodiment

This embodiment provides a putter head which imparts top spin, that is smaller in amount than in a general putter, to a ball upon striking the ball, to eventually facilitate creation of back spin of the ball.

FIGS. 8A to 11 show a putter head 21 according to the second embodiment. The putter head 21 is provided with a recessed portion 22H in the front surface (face surface) of a head body 22, and a face insert 23 is disposed in the recessed portion 22H. In this embodiment, the head body 22 is made of a metal such as an aluminum alloy, a titanium alloy, a copper alloy, or stainless steel. The body portion (a portion other than viscoelastic materials 23*b*; to be described later) of the face insert 23 is made of a synthetic resin such as polyester, nylon, or urethane, or a metal such as an aluminum alloy, a copper alloy, or stainless steel. The front surface of the face insert 23 is flush with that of the head body 22 around the recessed portion 22H.

The recessed portion 22H and face insert 23 have an elongated, almost rectangular shape. The recessed portion 22H has a uniform depth as a whole, and the face insert 23 has a uniform thickness as a whole as well. However, the recessed portion 22H and face insert 23 may be partly provided with a deep portion and thick portion, respectively, or conversely, a shallow portion and thin portion, respectively.

The face insert 23 has a horizontal dimension and vertical dimension slightly smaller than the recessed portion 22H, so a small gap 24 is formed between upper, lower, left, and right side surfaces 23S of the face insert 23 and a peripheral surface 22S of the recessed portion 22H. The width of the gap 24 is preferably 0.3 to 1.5 mm and more preferably about 0.4 to 1.0 mm. As for the size of the face insert 23, its vertical dimension is preferably 16 to 30 mm and more preferably about 18 to 25 mm, its horizontal dimension is preferably 50 to 150 mm and more preferably about 70 to 100 mm, and its thickness is preferably 2 to 10 mm and more preferably about 3 to 8 mm. However, the size of the face insert 23 is not limited to these specific values.

Figure 9:
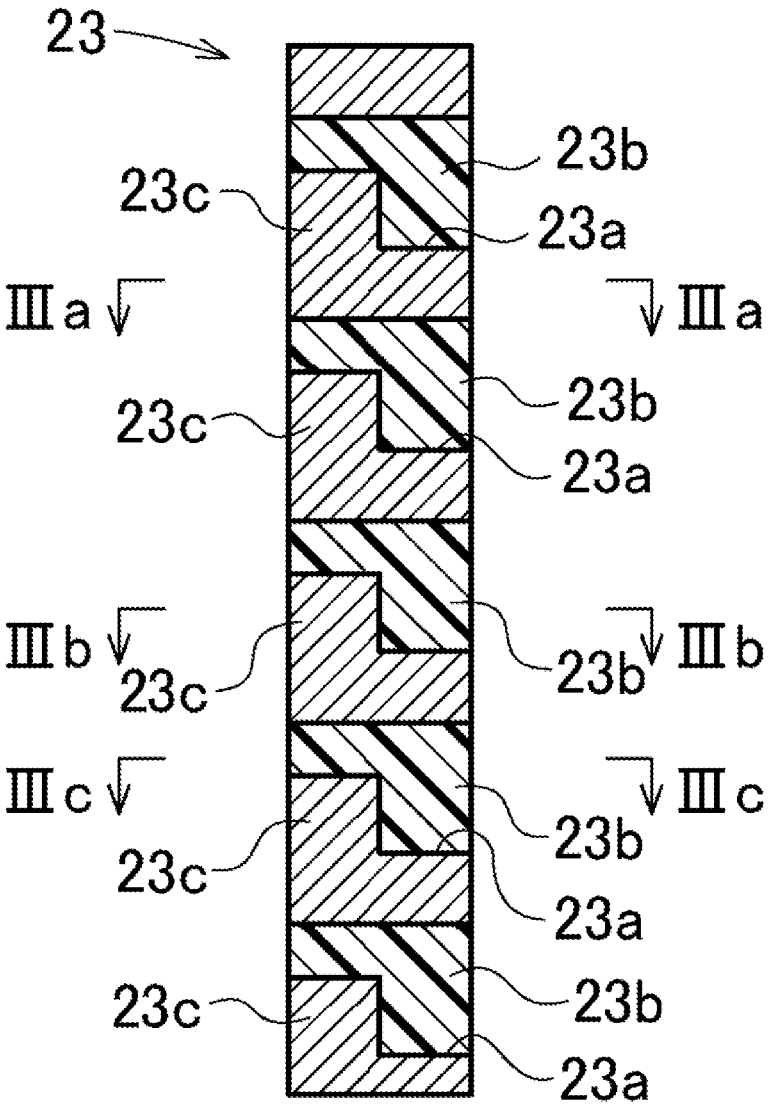
FIG. 9 is a sectional view taken along a line II-II in FIG. 8A.
Figures 10A, 10B, 10C:
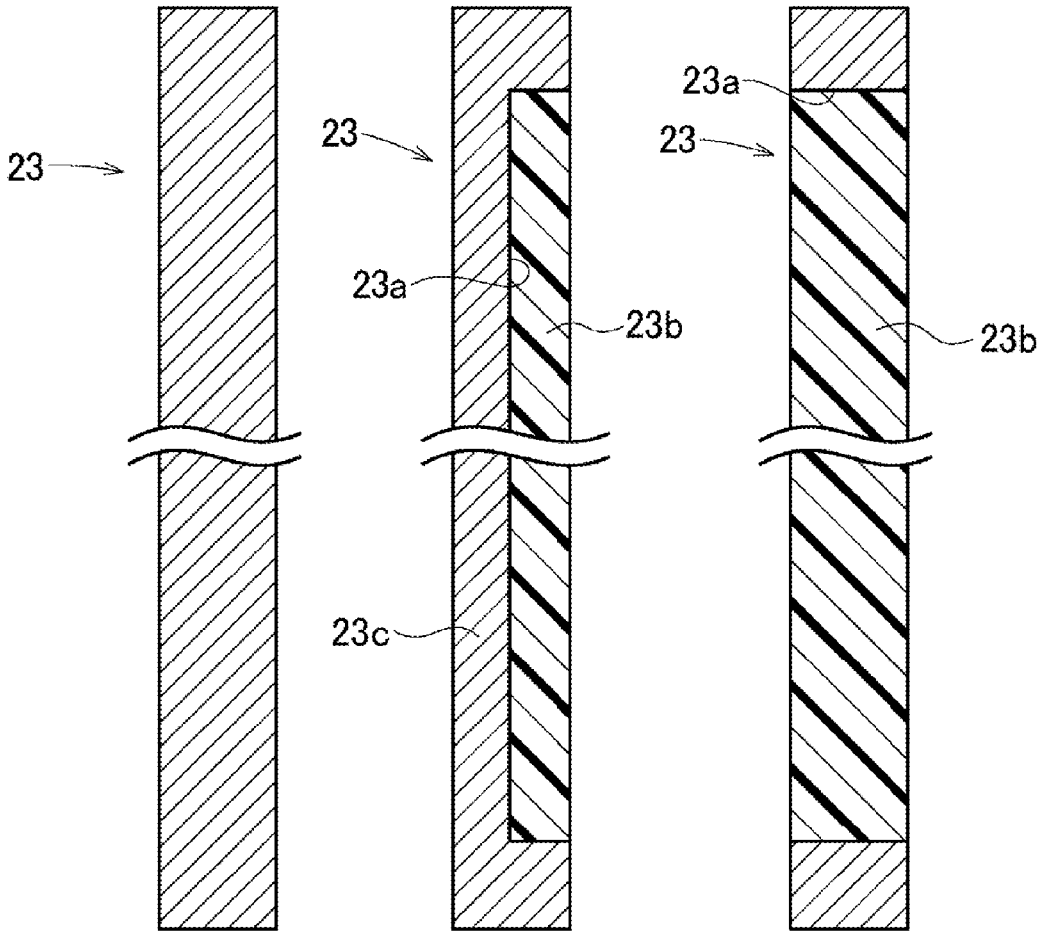
FIGS. 10A to 10C are sectional views taken along lines IIIa-IIIa, IIIb-IIIb, and IIIc-IIIc, respectively, in FIG. 9.
Figure 11:
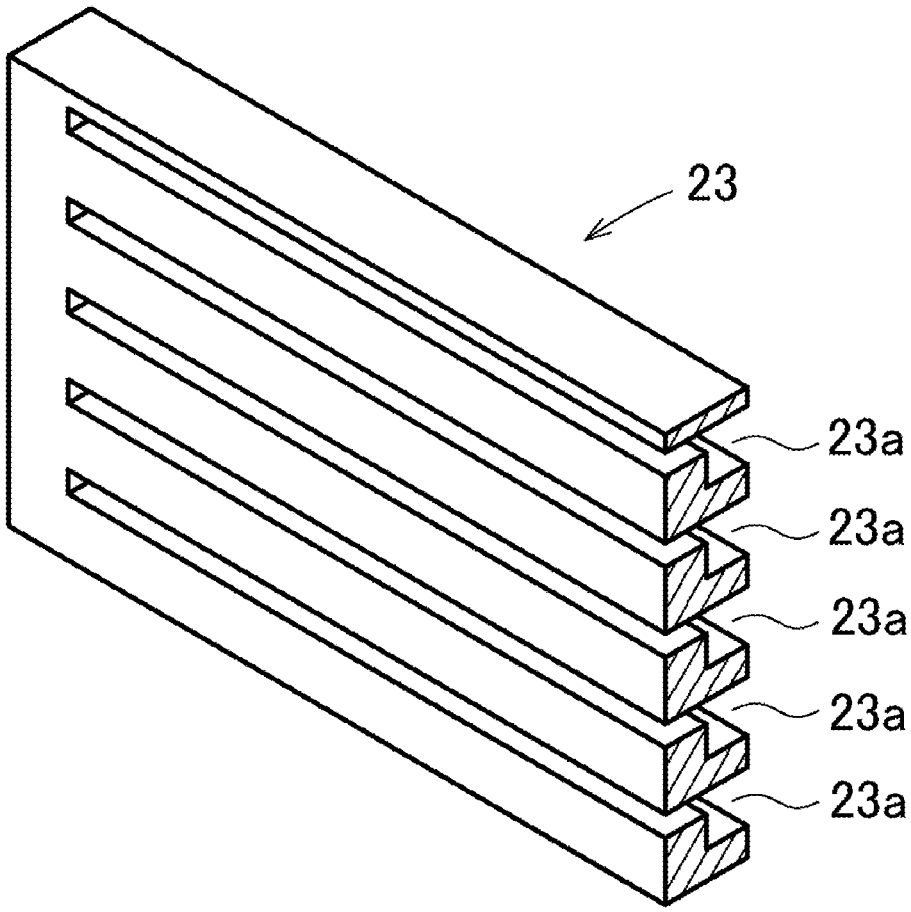
FIG. 11 is a sectional perspective view of the body portion of a face insert from which viscoelastic materials are removed.
Figure 12A:
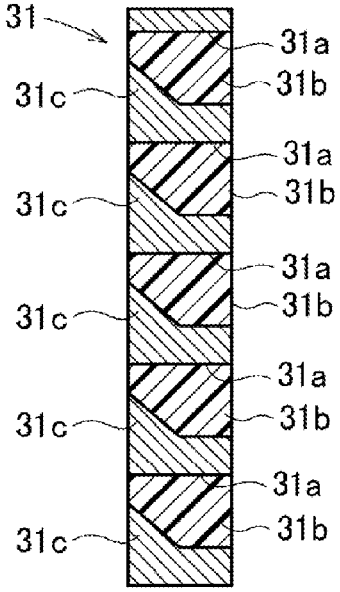
FIGS. 12A to 12D are sectional views of face inserts of putter heads each according to still another embodiment.
Figure 12B:
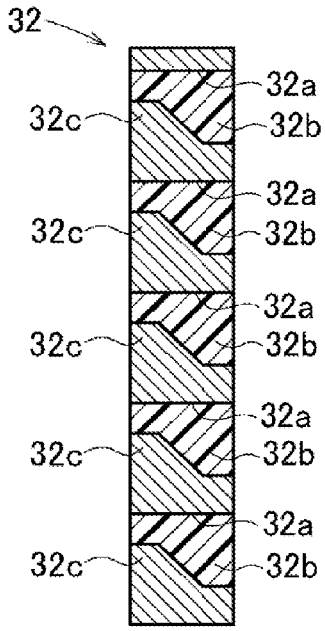
Figure 12C:
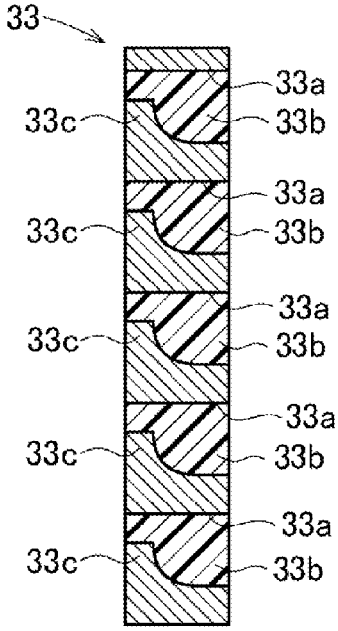
Figure 12D:
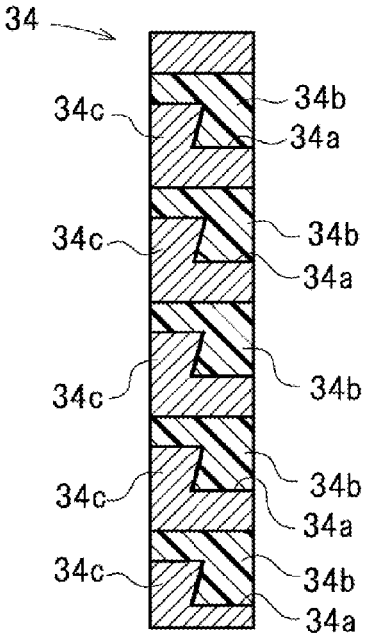

The face insert 23 is provided with slits 23*a* which are vertically aligned in multiple stages so as to extend horizontally, and each of which is filled with a viscoelastic material 23*b*, as shown in FIGS. 9 to 11. Rubber, an elastomer, or a soft synthetic resin, for example, is used as the viscoelastic material 23*b*.

The slit 23*a* extends from the vicinity of the left end of the face insert 23 to that of its right end. The slit 23*a* has a relatively small vertical dimension on the side of the face surface, and has a relatively large vertical dimension on the side of the rear surface. The vertical dimension of the slit 23*a* increases stepwise in the middle of the thickness direction of the face insert 23. The body portion of the face insert 23 immediately above each slit 23*a* has an L-shaped cross-section having a raised portion 23*c* on the side of the face surface.

The vertical dimension of the slit 23*a* on the side of the face surface is preferably 0.8 to 2.0 nm and more preferably about 1.0 to 1.6 mm. The vertical dimension of the slit 23*a* on the side of the rear surface is preferably about 1.4 to 4 times that on the side of the face surface. The thickness of the raised portion 23*c* (its thickness in a direction perpendicular to the face surface) is preferably 0.5 to 2.0 mm and more preferably about 0.8 to 1.2 mm. The array pitch of the slits 23*a* in the vertical direction is preferably 2.4 to 5.8 mm and more preferably about 3.4 to 4.6 mm.

The face insert 23 is disposed in the recessed portion 22H such that its left side surface when viewed in FIG. 9 becomes the face front surface of the putter, and its opposite surface is bonded to the bottom wall surface of the recessed portion 22H using an adhesive. Although an epoxy adhesive, a rubber adhesive, or a double-faced tape, for example, is suitable as an adhesive, the present invention is not limited to these specific adhesives.

A putter is formed by connecting a shaft to a hosel portion 21*h* of the thus formed putter head 21. Upon putting with this putter (striking a ball on a green with the face surface), the raised portions 23*c* of the face insert 23 slightly recede upon hitting the ball. This reduces the amount of top spin on the ball, thus easily imparting back spin to the ball. Therefore, in a slightly rough green or a green with good rolling properties, the feel of distance can easily be adjusted by lowering the rolling property. That is, in general, a ball hit with a putter moves by sliding on the green surface with no rotation or low-speed rotation immediately after separating from the face surface of the putter, and, after a while, rolls without sliding on the green by friction between the ball and the green surface (the peripheral velocity and moving velocity of the ball become equal to each other). When a force which acts on a ball in the top spin direction upon hitting it with a putter head reduces, or when a force acts on a ball in the back spin direction upon hitting it with the putter head, the distance of sliding movement with no rotation or low-speed rotation immediately after the hitting increases. If the green surface is rough, the influence that the green surface exerts on the ball reduces during sliding movement with no rotation or low-speed rotation immediately after hitting. As a result, the total rolling distance until the ball stops becomes nearly equal to that in a general green. Also, in a green with good rolling properties (more specifically, a green in which lawn grass is cut short or a green tightened by, for example, a roller), rolling of the ball immediately after hitting it is suppressed as top spin is reduced or back spin is generated. Thus, the total rolling distance until the ball stops becomes nearly equal to that in a general green. From the foregoing description, the putter head according to the present invention allows the player to easily adjust the feel of distance in a slightly rough green or a green with good rolling properties, that is, allows the ball to roll only by a distance intended by the player.

Although the rear surface of the raised portion 23*c* is almost vertical in the above-described embodiment, the rear surfaces of raised portions 31*c* to 34*c* may have shapes different from that of the raised portion 23*c*, like face inserts 31 to 34 shown in FIGS. 12A to 12D, respectively. In an example shown in FIG. 12A, the rear surface of the raised portion 31*c* is an inclined surface which is continuous with the face surface and obliquely descends from the contact portion with it to the rear surface of the face insert 31. In an example shown in FIG. 12B, the rear surface of the raised portion 32*c* is inclined more to the rear toward its lower portion from the middle portion of the face insert 32 in its thickness direction. In an example shown in FIG. 12C, the rear surface of the raised portion 33*c* is a concavely curved surface. In an example shown in FIG. 12D, the rear surface of the raised portion 34*c* is inclined more to the front toward its lower portion from the middle portion of the face insert 34 in its thickness direction.

In all of the examples shown in FIGS. 12A to 12D, slits 31*a* to 34*a* are filled with viscoelastic materials 31*b* to 34*b*, respectively.

Although the body portion of the face insert and the front surface of the viscoelastic material are flush with each other, and the front surface of the face insert is flat in the above-described embodiment, the viscoelastic member may recede from the body portion of the face insert by about 0.05 to 1.1 mm.

Figure 8A:
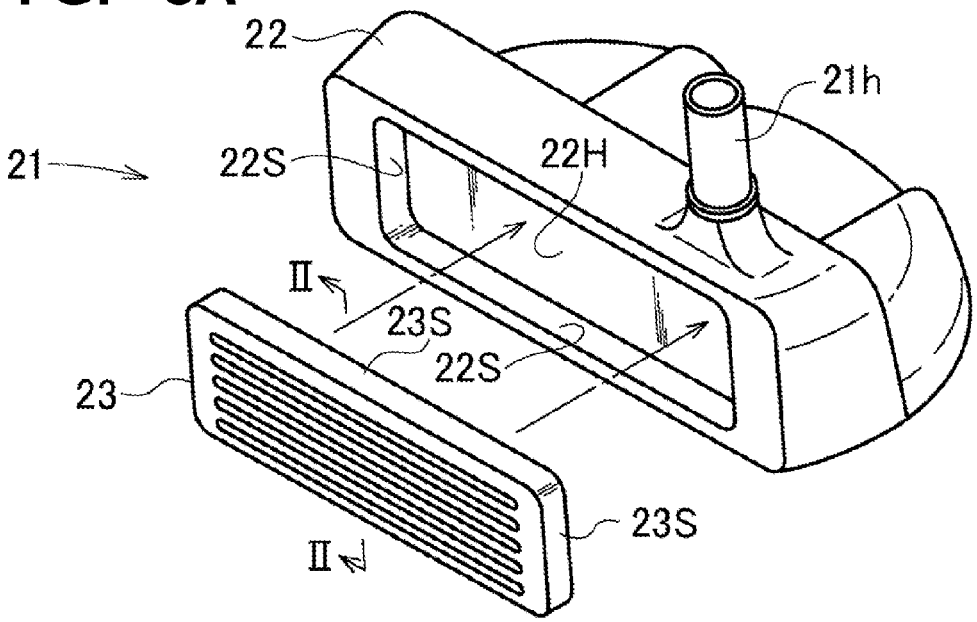
FIG. 8A is an exploded perspective view of a putter head according to still another embodiment.
Figure 8B:
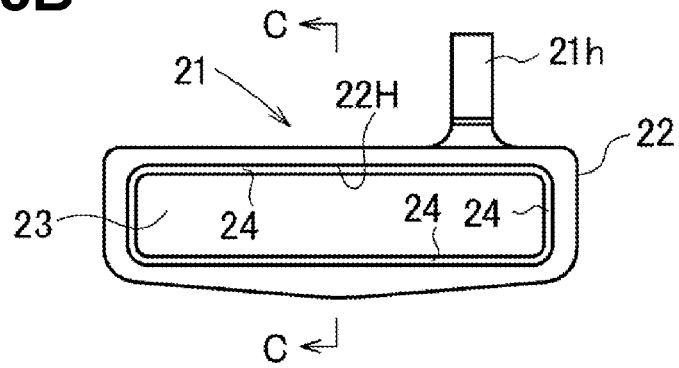
FIG. 8B is a front view of the putter head shown in FIG. 8A.
Figure 13:
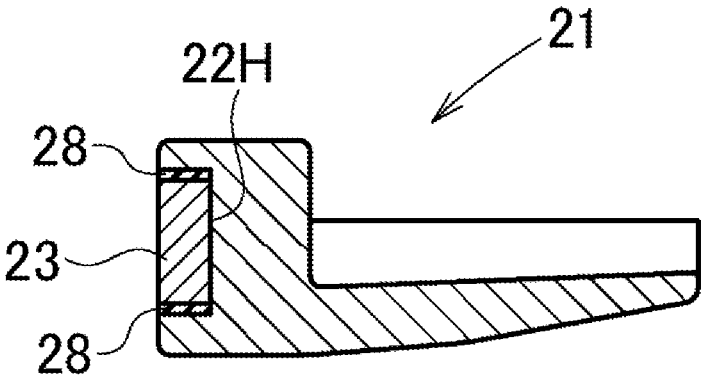
FIG. 13 is a sectional view of a putter head according to still another embodiment.
Figure 14A:
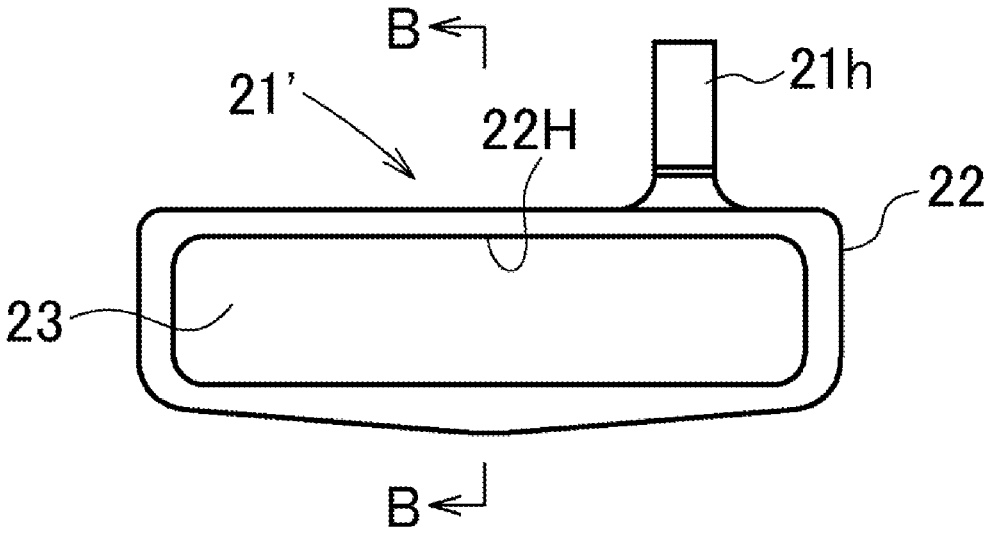
FIG. 14A is a front view of a putter head according to still another embodiment.

Although the gap 24 is formed around the face insert 23 in FIG. 8B, a viscoelastic material 28 such as rubber, an elastomer, or a synthetic resin may be disposed in the gap 24, as shown in FIG. 13. Also, like a putter head 21' shown in FIGS. 14A and 14B, the face insert 23 may be formed to tightly fit in the recessed portion 22H so as to generate no gap 24.

Figure 8C:
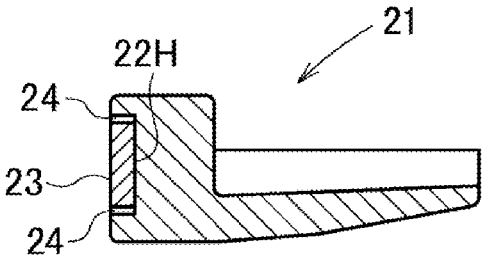
FIG. 8C is a sectional view taken along a line C-C in FIG. 8B.
Figure 14B:
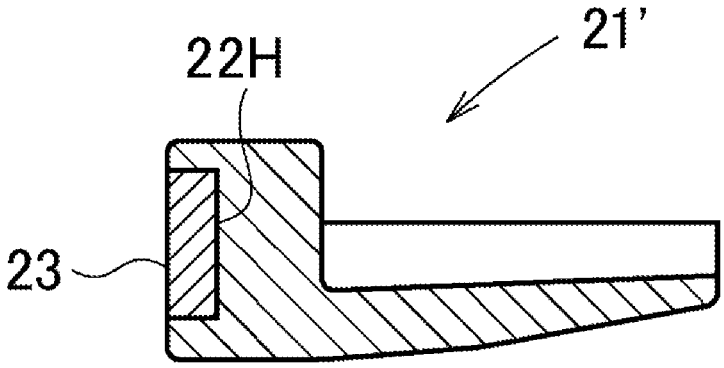
FIG. 14B is a sectional view taken along a line B-B in FIG. 14A.

Other arrangements in FIGS. 13 to 14B are the same as in FIG. 8A to 8C, and the same reference numerals denote the same parts. When the gap 24 or the viscoelastic material 28 is provided between the side surfaces 23S of the face insert 23 and the peripheral surface 22S of the recessed portion 22H, this prevents generation of residual stress in the face insert, thus producing an effect of obtaining rebound characteristics of the face insert, which comply with the design.

Third Embodiment

This embodiment provides a putter head which imparts back spin, that is smaller in amount than in a general putter, to a ball upon striking the ball, to eventually facilitate creation of top spin of the ball.

FIGS. 15A to 17C show a putter head 41 according to the third embodiment. The putter head 41 is provided with a recessed portion 42H in the front surface (face surface) of a head body 42, and a face insert 43 is disposed in the recessed portion 42H. In this embodiment, the head body 42 is made of a metal such as an aluminum alloy, a titanium alloy, a copper alloy, or stainless steel. The face insert 43 includes a face insert body 44 formed from a viscoelastic body, and a plurality of blades 45 buried in the face insert body 44.

The recessed portion 42H and face insert body 44 have an elongated, almost rectangular shape. The recessed portion 2H has a uniform depth as a whole, and the face insert body 44 has a uniform thickness as a whole as well. However, the recessed portion 42H and face insert body 44 may be partly provided with a deep portion and thick portion, respectively, or conversely, a shallow portion and thin portion, respectively.

The face insert body 44 has a horizontal dimension and vertical dimension slightly smaller than the recessed portion 42H, so a small gap 46 is formed between upper, lower, left, and right side surfaces 43S of the face insert body 44 and a peripheral surface 42S of the recessed portion 42H. The width of the gap 46 is preferably 0.3 to 1.5 mm and more preferably about 0.4 to 1.0 mm. As for the size of the face insert body 44, its vertical dimension is preferably 16 to 30 mm and more preferably about 18 to 25 mm, its horizontal dimension is preferably 50 to 150 mm and more preferably about 70 to 100 mm, and its thickness is preferably 2 to 10 mm and more preferably about 3 to 8 mm. However, the size of the face insert 3 is not limited to these specific values.

A material such as rubber, an elastomer, or a soft synthetic resin is used as a viscoelastic material which forms the face insert body 44. These materials may be a foam material such as foam rubber.

In this embodiment, the blades 45 have a flat plate shape and are vertically aligned in multiple stages with predetermined spacings between them. Each blade 45 has its front end positioned on the front surface (face surface) of the face insert body 44. Each blade 45 is tilted higher toward its rear end portion. The tilt angle θ of each blade 45 while the front surface of the face insert body 44 is kept vertical is preferably 20° to 70° and more preferably about 30° to 60°.

The array pitch of the blades 45 in the vertical direction is preferably 0.9 to 2.5 mm and more preferably about 1.0 to 1.5 mm. Stainless steel, titanium, or a titanium alloy, for example, is suitable as the material of the blades 45. The thickness of the blade 45 is preferably 0.4 to 0.7 mm and more preferably about 0.45 to 0.65 mm.

Figure 17A:
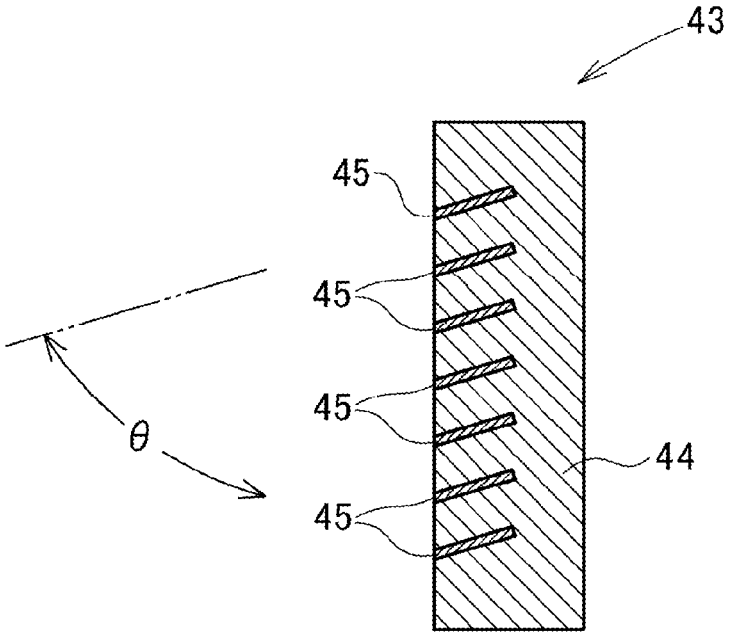
FIG. 17A is a sectional view taken along a line III-III in FIG. 16.

The face insert 43 is disposed in the recessed portion 42H such that its left side surface when viewed in FIG. 17A becomes the face front surface of the putter, and its opposite surface is bonded to the bottom wall surface of the recessed portion 2H using an adhesive. Although an epoxy adhesive, a rubber adhesive, or a double-faced tape, for example, is suitable as an adhesive, the present invention is not limited to these specific adhesives.

A putter is formed by connecting a shaft to a hosel portion 41*h* of the thus formed putter head 41. Upon putting with this putter (striking a ball on a green with the face surface), the front end sides of the blades 45 are displaced downward and obliquely backward upon hitting the ball, thereby facilitating production of top spin. Thus, the hit ball exhibits good rectilinear movement characteristics.

Figure 17B:
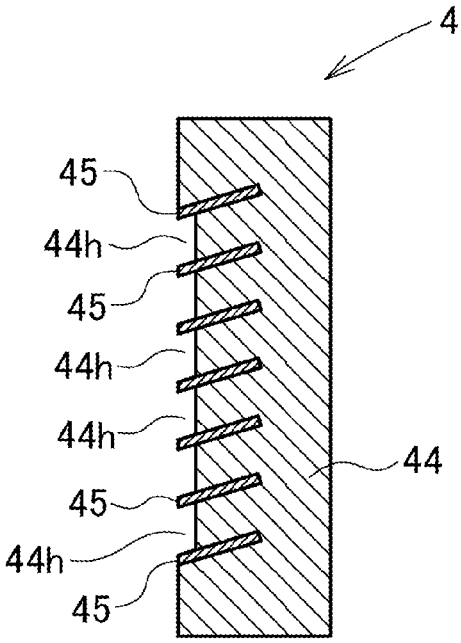
FIGS. 17B and 17C are sectional views each showing another example.
Figure 17C:
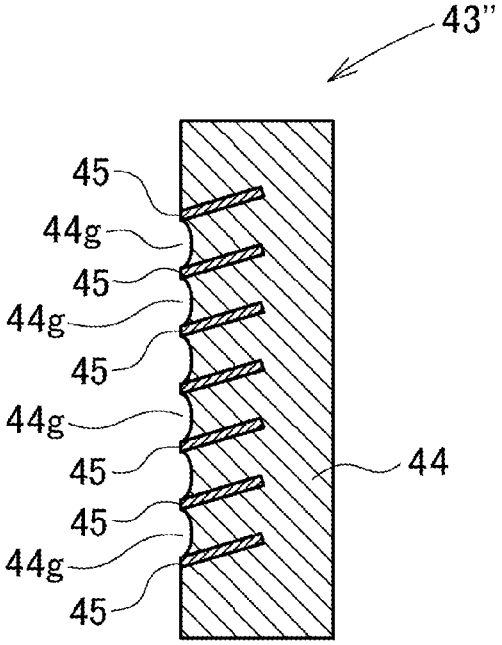

Although the front surface of the face insert 43 is flat in FIG. 17A, recessed portions 44*h* or 44*g* may be provided in the face insert body 44 between the blades 45, like face inserts 43' and 43" shown in FIGS. 17B and 17C, respectively. The recessed portions 44*h* have a uniform depth between the blades 45. The recessed portions 44*g* have an almost arcuated longitudinal section. The depths of the recessed portions 44*h* and 44*g* are preferably about 0.5 to 1.0 mm.

Note that to fabricate the face insert 43, the blades 45 are preferably inserted into the face insert body 44 formed from a viscoelastic body. In this case, the blades 45 may be individually inserted into the face insert body 44 one by one. Alternatively, the face insert 43 may be fabricated by stacking the blades 45 via appropriate spacers between them to form a stacked body, inserting the proximal ends of the blades 45 of the stacked body into the face insert body 44, and then removing the spacers.

Figure 18:
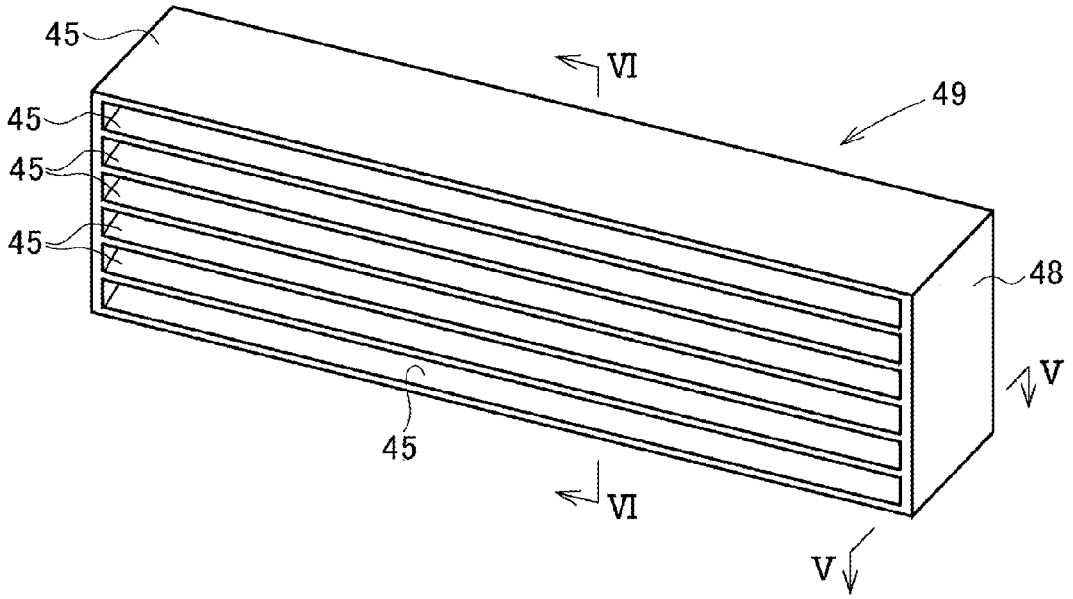
FIG. 18 is a perspective view of a blade unit of a putter head according to still another embodiment.
Figure 19:
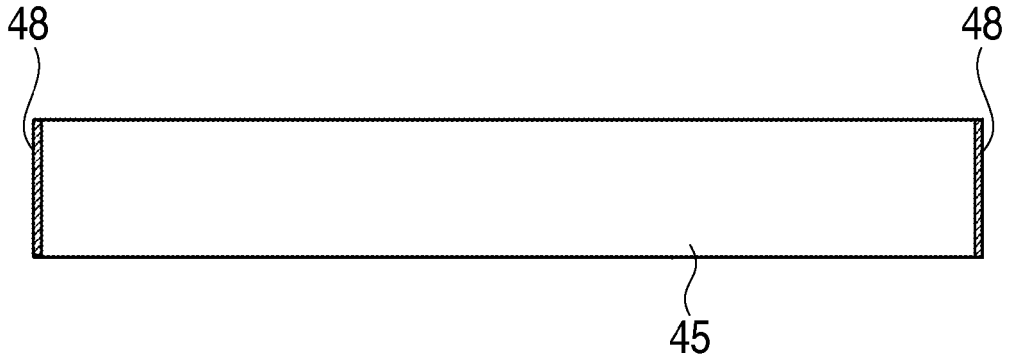
FIG. 19 is a sectional view taken along a line V-V in FIG. 18.
Figure 20:
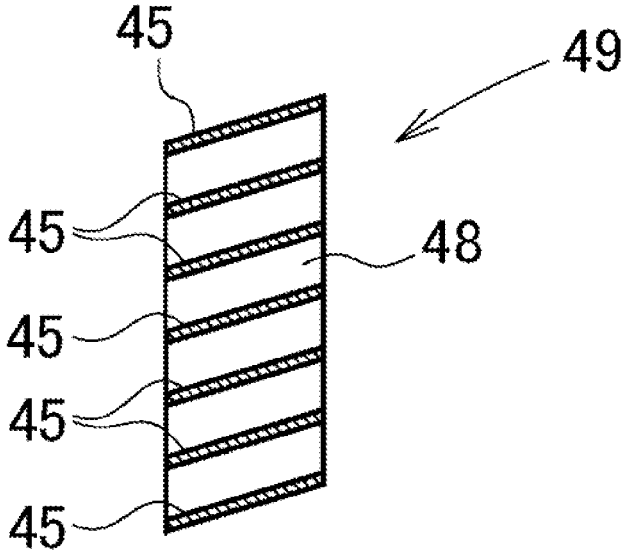
FIG. 20 is a sectional view taken along a line VI-VI in FIG. 18.

Instead of using such spacers, the face insert 43 may be fabricated by fabricating, in advance, a blade unit 49 in which the side portions of the plurality of blades 45 to each other by a plate portion 48, and inserting the blade unit 49 into the face insert body 44, as shown in FIGS. 18 to 20.

Figure 21:
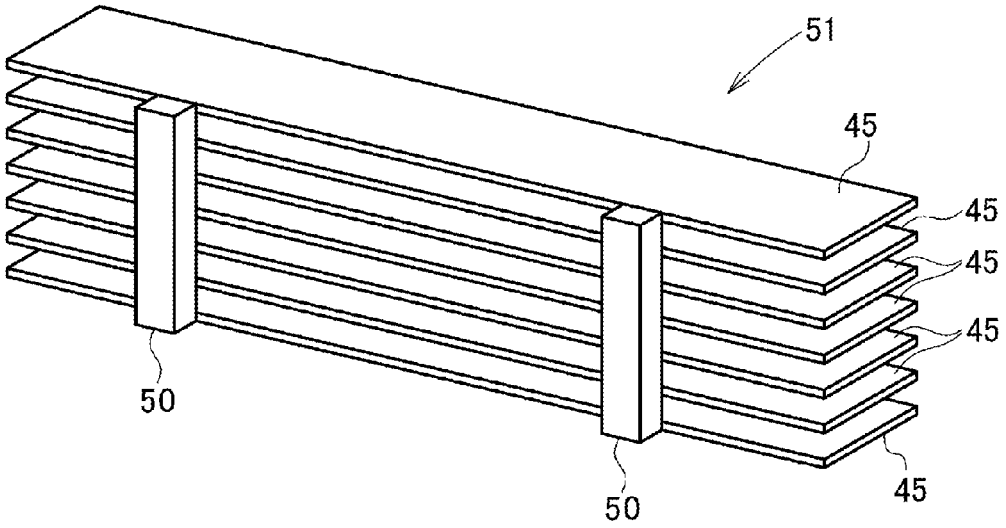
FIG. 21 is a perspective view of a blade unit of a putter head according to still another embodiment.

Also, the face insert 43 may be fabricated by temporarily fixing the distal ends of the blades 45 to connecting members 50 using, for example, an adhesive to form a blade unit 51, inserting the blades 45 of the blade unit 51 into the face insert body 44, and then, for example, dissolving the adhesive in a solvent to remove the connecting members 50, as in an example shown in FIG. 21.

Note that the face insert 43 may be fabricated by setting the blades 45 in a mold, and injecting a viscoelastic body into the mold.

Figure 22:
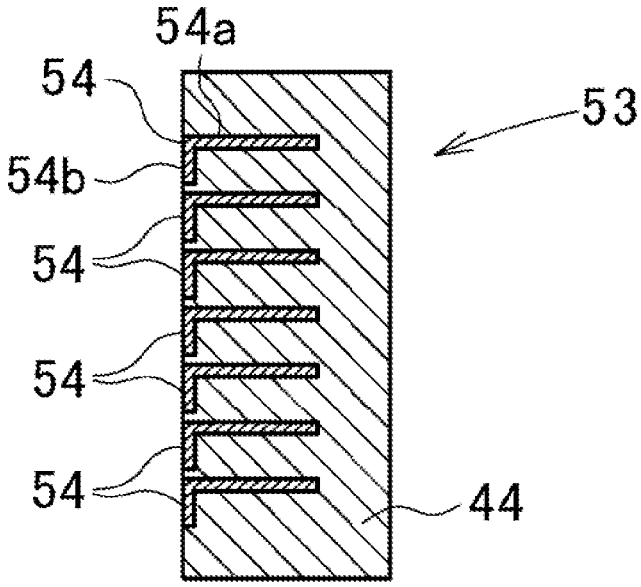
FIGS. 22 and 23 are sectional views of face inserts of putter heads each according to another embodiment.

Although the blades 45 have a flat plate shape in the above-described embodiment, blades 54 having an L-shaped cross-section may be used, like a face insert 53 shown in FIG. 22. Each blade 54 includes a horizontal portion 54*a* which almost horizontally extends in the face insert body 44, and a depending portion 54*b* which depends from the front end of the horizontal portion 54*a*.

Figure 23:
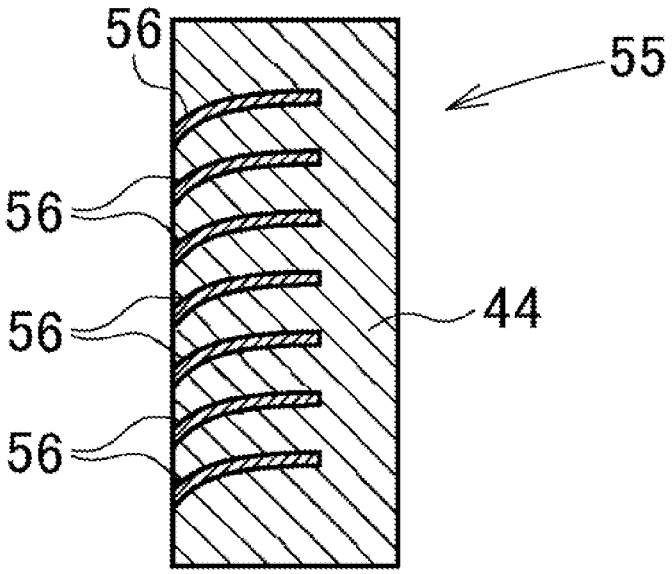

Also, blades 56 having a curved plate shape which is convexly curved upward so that it is curved more acutely toward the front end may be used, like a face insert 55 shown in FIG. 23.

Figure 15A:
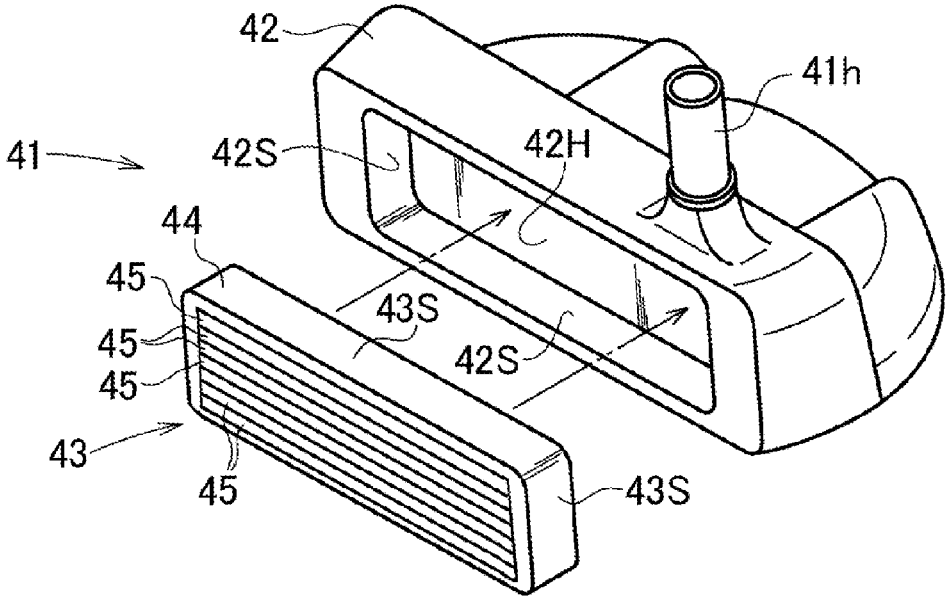
FIG. 15A is an exploded perspective view of a putter head according to still another embodiment.
Figure 15B:
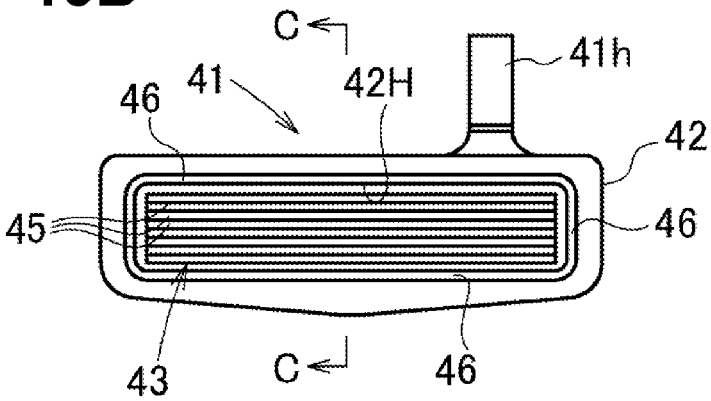
FIG. 15B is a front view of the putter head shown in FIG. 15A.
Figure 15C:
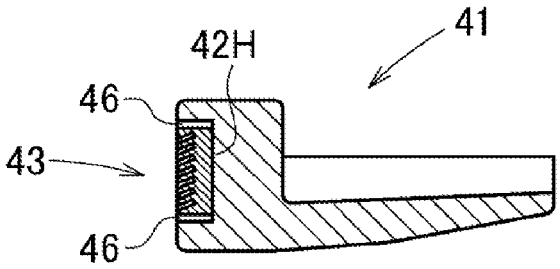
FIG. 15C is a sectional view taken along a line C-C in FIG. 15B.
Figure 16:
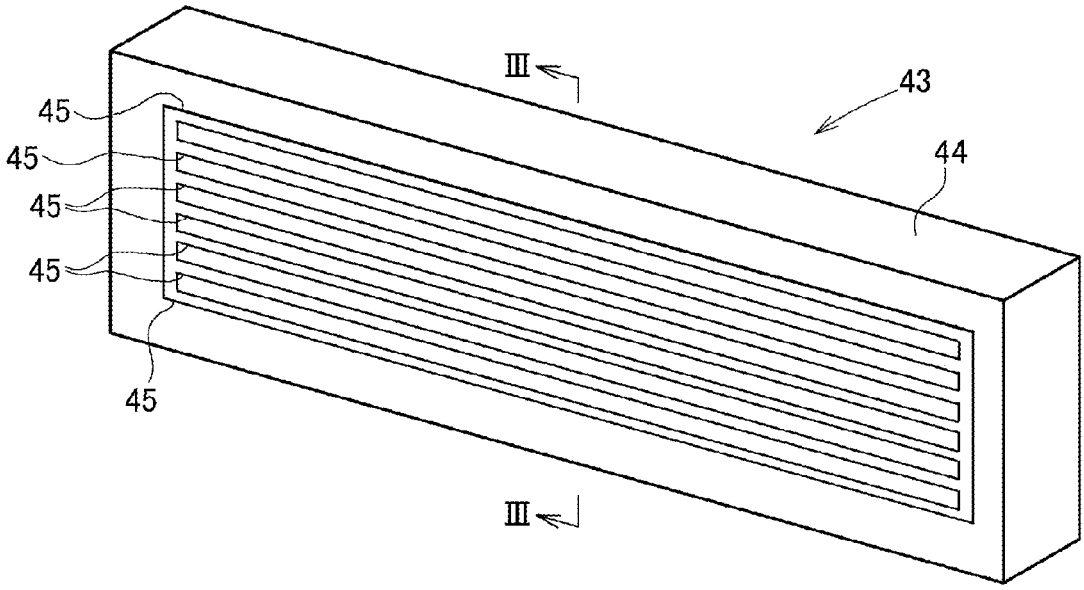
FIG. 16 is a perspective view of a face insert.

Although the gap 46 is formed around the face insert 43 in an example shown in FIG. 15B, it may be filled with a viscoelastic material such as rubber, an elastomer, or a synthetic resin. Also, the face insert body 44 may be formed to tightly fit in the recessed portion 42H so as to generate no gap 46.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-281803, filed Dec. 17, 2010, No. 2010-281806, filed Dec. 17, 2010, and No. 2010-287827, filed Dec. 24, 2010, which are hereby incorporated by reference herein in their entirety.

What is claimed is:

1. A putter head comprising a head body and a face insert mounted on a face surface of the head body, wherein slits are vertically aligned so as to extend in the face insert in a toe-to-heel direction, the face insert comprises:

a main portion forming the slits; and depending portions, the main portion and each depending portion are integrally formed and are made of the same material, each depending portion is provided in a corresponding one of the slits on a side of the face surface so that a vertical dimension of the slit on a rear side is larger than a vertical dimension of the slit on the side of the face surface, and the slit is filled with a viscoelastic material.

2. The head according to claim 1, wherein a vertical dimension of each slit on a rear surface of the face insert is 1.4 to 4.0 times a vertical dimension of the slit on the face surface.

3. The head according to claim 1, wherein an array pitch of the slits in a vertical direction is 2.4 to 5.8 mm.

4. The head according to claim 1, wherein the whole of each slit is filled with the viscoelastic material.

5. A putter head comprising a head body and a face insert mounted on a face surface of the head body, wherein slits are vertically aligned so as to extend in the face insert in a toe-to-heel direction, the face insert comprises:

a main portion forming the slits; and raised portions, the main portion and each raised portion are integrally formed and are made of the same material, each raised portion is provided in the slit on a side of the face surface so that a vertical dimension of the slit on a rear side is larger than a vertical dimension of the slit on the side of the face surface, and the slit is filled with a viscoelastic material.

6. The head according to claim 5, wherein a vertical dimension of each slit on a rear surface of the face insert is 1.4 to 4.0 times a vertical dimension of the slit on the face surface.

7. The head according to claim 5, wherein an array pitch of the slits in a vertical direction is 2.4 to 5.8 mm.

8. The head according to claim 5, wherein the whole of each slit is filled with the viscoelastic material.

9. A putter head comprising a head body and a face insert mounted on a face surface of the head body, wherein the face insert includes a plate-shaped face insert body formed from a viscoelastic body, and a plurality of blades which are vertically buried in at least a front surface portion of said face insert body, each of said blades extend in a toe-to-heel direction, and a front end thereof is lower than a rear end thereof, and each of said blades include a horizontal portion which extends substantially horizontally from a front surface of said face insert body to a rear surface thereof, and a depending portion which depends from a front end of said horizontal portion.

* * * * *